US009226863B1

(12) United States Patent
El-Messeiry et al.

(10) Patent No.: US 9,226,863 B1
(45) Date of Patent: Jan. 5, 2016

(54) MATTRESS FOR RELIEVING PRESSURE ULCERS

(71) Applicant: KING SAUD UNIVERSITY, Riyadh (SA)

(72) Inventors: Mamduh A. El-Messeiry, Riyadh (SA); Abdulaziz Binsaeed, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 14/673,802

(22) Filed: Mar. 30, 2015

(51) Int. Cl.

| | |
|---|---|
| ***A47C 27/08*** | (2006.01) |
| ***A61G 7/057*** | (2006.01) |
| ***A47C 21/00*** | (2006.01) |
| ***A47C 31/00*** | (2006.01) |

(52) U.S. Cl.
CPC ..... *A61G 7/05769* (2013.01); *A47C 21/006* (2013.01); *A47C 31/007* (2013.01); *A61G 7/057* (2013.01); *A61G 2007/05784* (2013.01)

(58) Field of Classification Search
CPC ..... A61G 7/05769; A61G 7/057; A61G 2007/05784; A47C 21/006
See application file for complete search history.

(56) References Cited

U.S. PATENT DOCUMENTS

| | | | | |
|---|---|---|---|---|
| 5,007,410 | A * | 4/1991 | DeLaney | 5/694 |
| 5,652,987 | A * | 8/1997 | Fujita | 5/726 |
| 5,794,289 | A | 8/1998 | Wortman et al. | |
| 6,175,981 | B1 * | 1/2001 | Lizama et al. | 5/655 |
| 8,372,182 | B2 | 2/2013 | Vrzalik et al. | |
| 8,418,296 | B1 * | 4/2013 | Hanlon et al. | 5/713 |
| 8,572,783 | B2 | 11/2013 | Moutafis | |
| 2007/0033733 | A1 * | 2/2007 | Jen | 5/423 |
| 2007/0056101 | A1 | 3/2007 | Mahajan et al. | |
| 2008/0010751 | A1 | 1/2008 | Kemper et al. | |
| 2010/0058541 | A1 | 3/2010 | Kemper | |
| 2010/0319125 | A1 * | 12/2010 | Ko | 5/423 |
| 2011/0185508 | A1 * | 8/2011 | Hsu et al. | 5/706 |
| 2013/0067661 | A1 * | 3/2013 | Schwirian et al. | 5/600 |
| 2013/0281804 | A1 | 10/2013 | Lee et al. | |

FOREIGN PATENT DOCUMENTS

| | | |
|---|---|---|
| KR | 10-2009-0049421 | 5/2009 |
| WO | WO 2013/157534 A1 | 10/2013 |

OTHER PUBLICATIONS

"Pressure Reducing Foam Mattress 6500 Lite," http://www.rehabmart.com/product/pressure-reducing-foam-mattress-6500-lite-32970.html (Last Accessed on Nov. 11, 2014) 3 pages.

Bishop, R.D. and Hay, J.G., Basketball: The Mechanics of Hanging in the Air., *Medicine and Science in Sports*, 11(3), 274-277 (1979). Abstract only.

* cited by examiner

*Primary Examiner* — David E Sosnowski
(74) *Attorney, Agent, or Firm* — Richard C. Litman

(57) ABSTRACT

The mattress for relieving pressure ulcers includes a first sponge layer, an air mattress layer over the first sponge layer, an intermediate layer over the air mattress layer, a second sponge layer over the intermediate layer, and a paper sheet layer over the second sponge layer. The sponge layer and the air mattress layer are configured to increase the contact area of the patient's body with the bed, according to a patient's weight. The intermediate layer is a rubber layer configured to provide ventilation for areas of the mattress that contact a patient's body using dry air or dry air mixed with ozone gas, essential/volatile oil, and/or antibacterial vapors. The second sponge layer is designed to distribute the air under the patient's body. The paper sheet layer is configured to provide alarms in the event the mattress gets wet due to sweating or incontinence.

4 Claims, 8 Drawing Sheets

MATTRESS FOR RELIEVING PRESSURE ULCERS

BACKGROUND OF THE INVENTION

1. Field of the Invention

The present invention relates generally to pressure ulcer treatment and, more particularly, to a mattress for relieving pressure ulcers and treating shallow open ulcers.

2. Description of the Related Art

A pressure ulcer is typically a localized injury to the skin and/or to the underlying tissue typically resulting from a combination of factors including pressure, shearing forces, friction, and moisture. Although pressure ulcers can normally be prevented and treated if found early, they can be very difficult to prevent in frail, elderly patients, those patients who have suffered severe trauma, and those patients who are confined to a wheelchair due to the lack of mobility/activity and pressure exerted on their skin. The lack of mobility/activity contributes to, if not causes, pressure ulcers because a lack of mobility/activity normally leads to unrelieved pressure on soft tissues overlaying a bony prominence. This unrelieved pressure either reduces or completely obstructs blood flow to the superficial tissue. The most common regions for pressure ulcers include the occiput, shoulder, elbow, sacrum, heel, hip, knee, ankle, ear, as well as the scapula, ischium, and the ball of the foot.

Recent investigations indicate that prolonged pressure exerted on the skin and the lack of mobility/activity leads to compression, tension and shear of the skin and the underlying tissue.

More than one and a half million hospitalized patients develop dermal pressure ulcers each year, which results in a significant increase in hospitalization costs and typically prolongs a patient's stay by 8.2 days.

Thus, a mattress for relieving pressure ulcers solving the aforementioned problems is desired.

SUMMARY OF THE INVENTION

An embodiment of a mattress for relieving pressure ulcers includes a first sponge layer, an air mattress layer over the first sponge layer, an intermediate layer over the air mattress layer, a second sponge layer over the intermediate layer, and a paper sheet layer over the second sponge layer. The sponge layer and the air mattress layer are configured to increase the contact area of the patient's body with the bed, according to a patient's weight. The intermediate layer is a rubber layer configured to provide ventilation for areas of the mattress that contact a patient's body using dry air or dry air mixed with ozone gas, essential/volatile oil, and/or antibacterial vapors. The second sponge layer is designed to distribute the air under the patient's body. The paper sheet layer is configured to provide alarms in the event the mattress gets wet due to sweating or incontinence.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
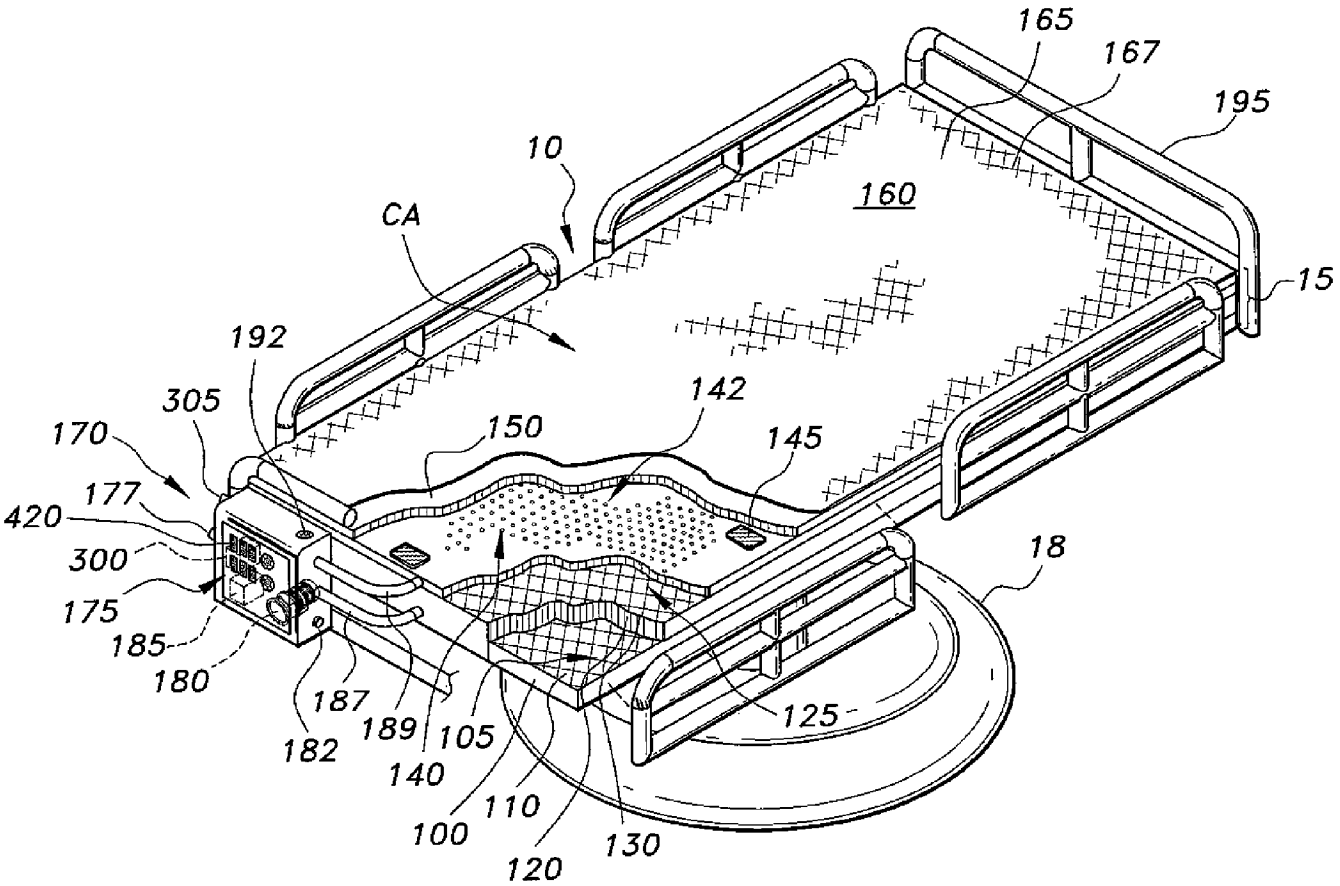
FIG. 1A is an environmental, perspective view of an embodiment of a mattress for relieving pressure ulcers according to the present invention.
Figure 2A:
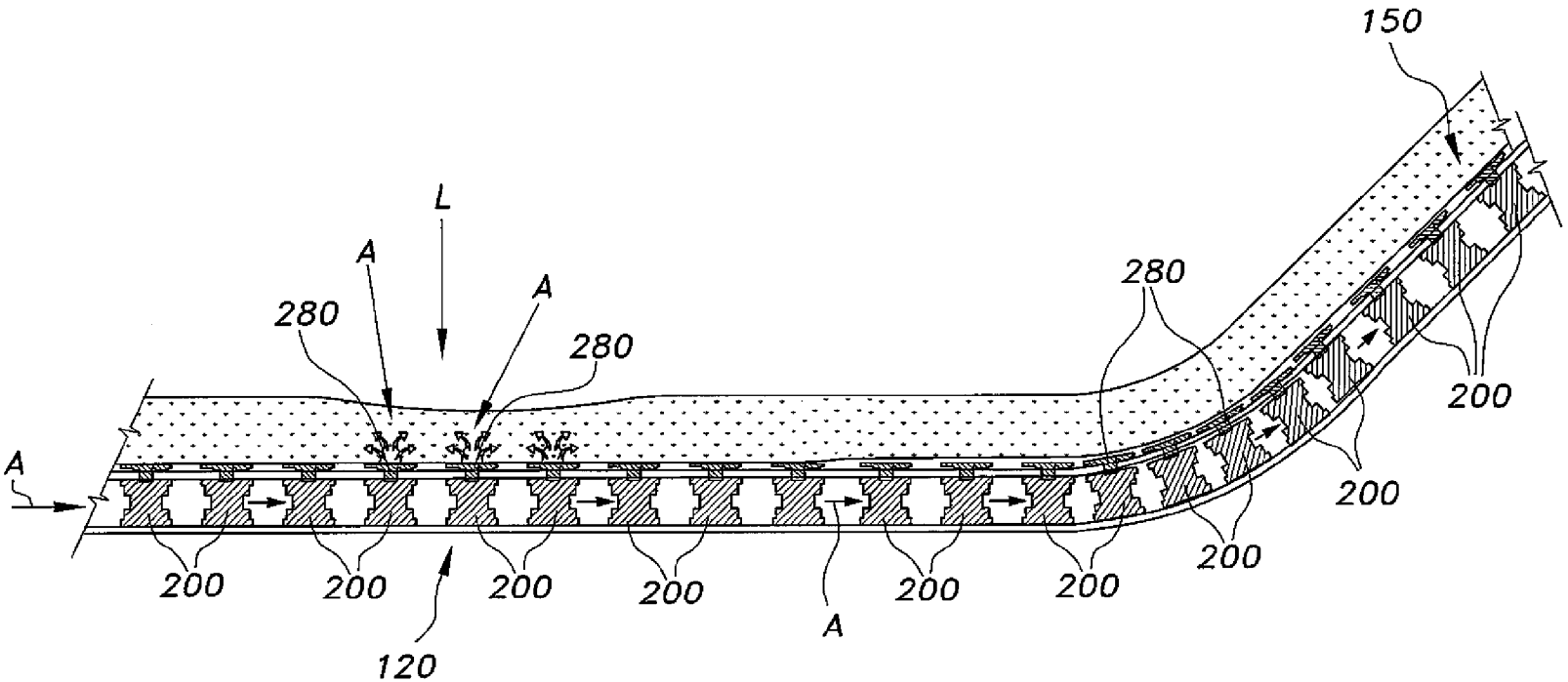
FIG. 2A is a sectional view of an embodiment of a mattress for relieving pressure ulcers according to the present invention.
Figure 2B:
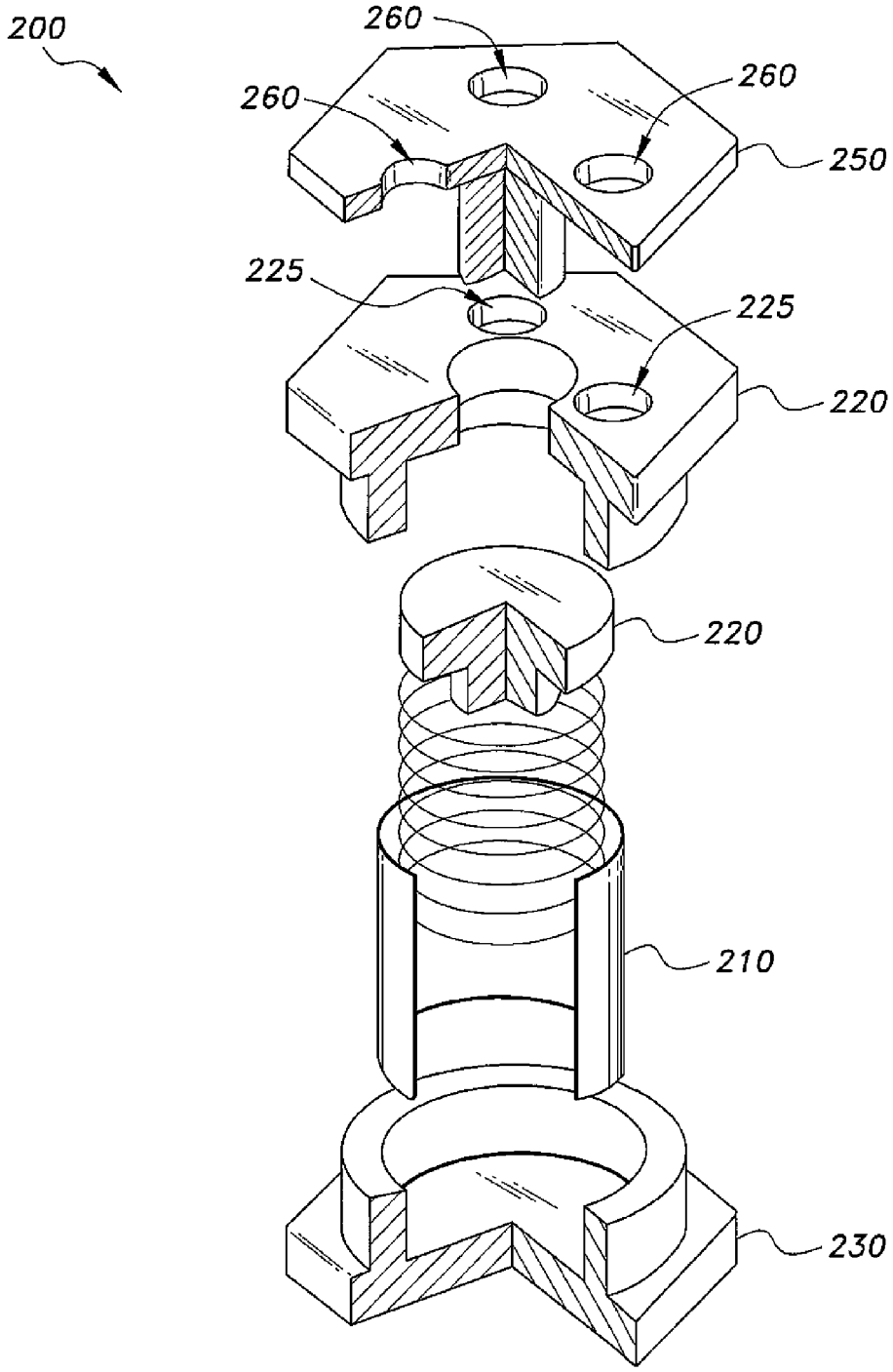
FIG. 2B is a schematic view of an embodiment of an air release unit according to the present invention.
Figure 2C:
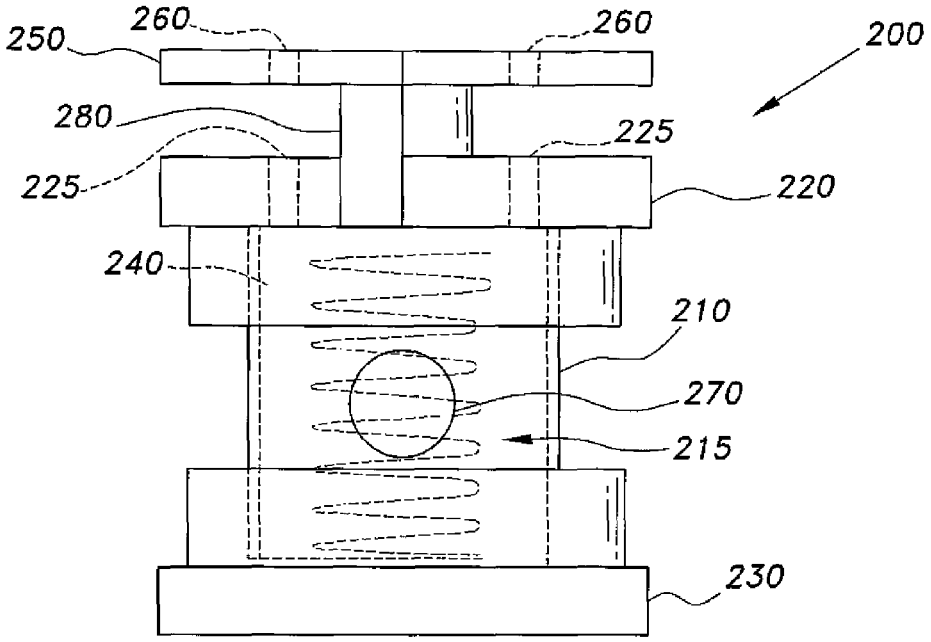
FIG. 2C is an schematic view of FIG. 2B according to the present invention.
Figure 3:
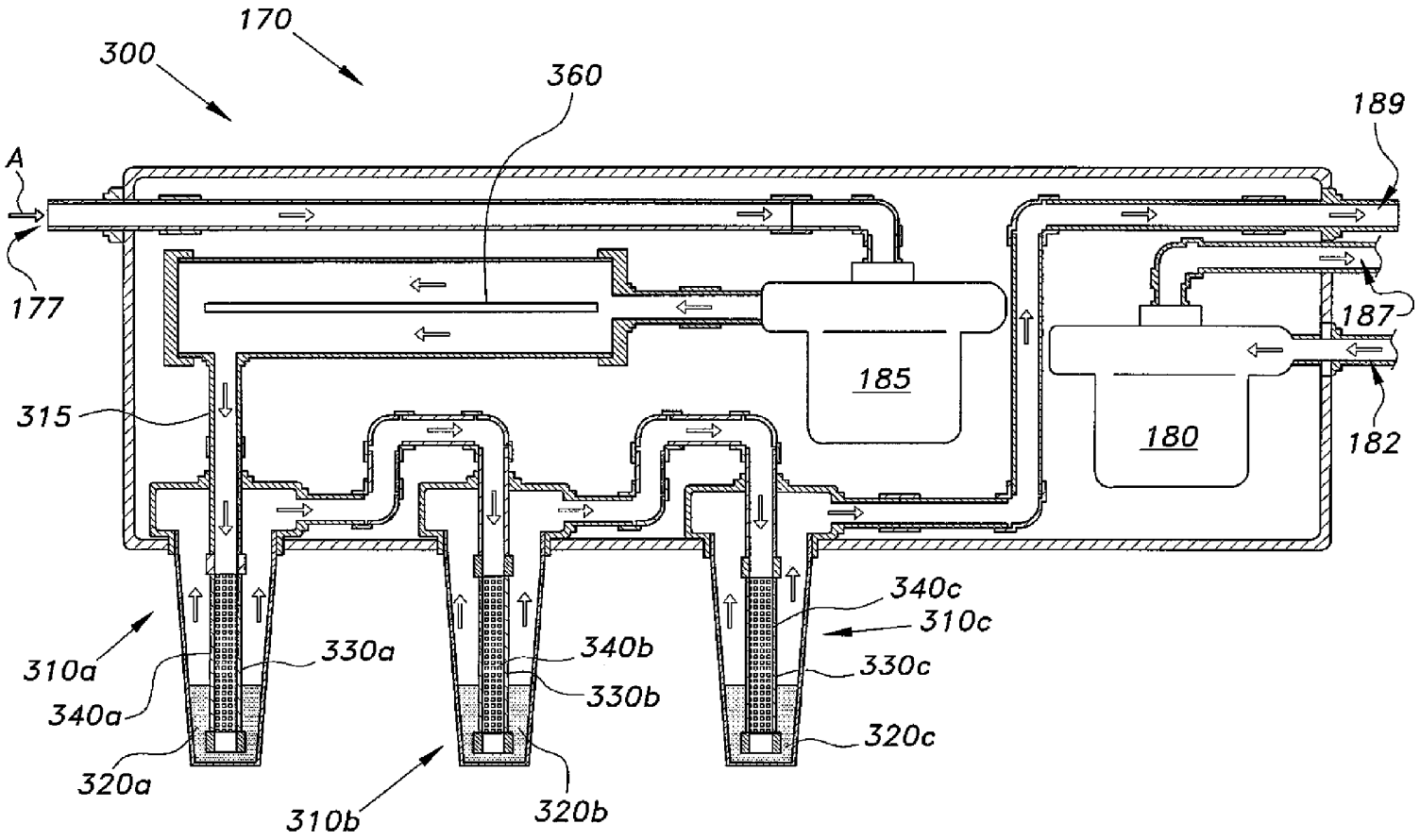
FIG. 3 is a sectional view of an embodiment of an air treatment unit for use in connection with a ventilation system for relieving pressure ulcers according to the present invention.

Referring to FIGS. 1A, 2A, and 3, an embodiment of a mattress 10 for relieving pressure ulcers is generally illustrated. The mattress 10 includes a plurality of layers 15 in stacked relation. The plurality of layers 15 can include a first sponge layer 100, an air mattress layer 120 over the first sponge layer 100, an intermediate layer 140 over the air mattress layer 120, a second sponge layer 150 over the intermediate layer 140, and a paper sheet layer 160 over the second sponge layer 150. The first sponge layer 100 can have a first electric conducting sheet 110 positioned on a first upper surface 105 of the first sponge layer 100. The air mattress layer 120 can have a second electric conducting sheet 130 positioned on a second upper surface 125 of the air mattress layer 120. The intermediate layer 140 can include rubber.

The intermediate layer 140 can be connected to a ventilation system 170 having an air treatment unit 300. The intermediate layer 140 can have a plurality of air release units 200. The air release units 200 receive air from the air treatment unit 300 and release air out of the intermediate layer 140 through a plurality of first openings 142 in the plurality of air release units 200. The air treatment unit 300 can be configured to mix air A from the ventilation system 170 with vapors from essential volatile oil and antibacterial liquids 320. The ventilation system 170 also includes a second opening 177, a control panel 175, a third opening 182 and at least one air compressor 185. The ventilation system 170 can include an ozone generator 360 (FIG. 3), in communicating relation with the air treatment unit 300.

Figure 1B:
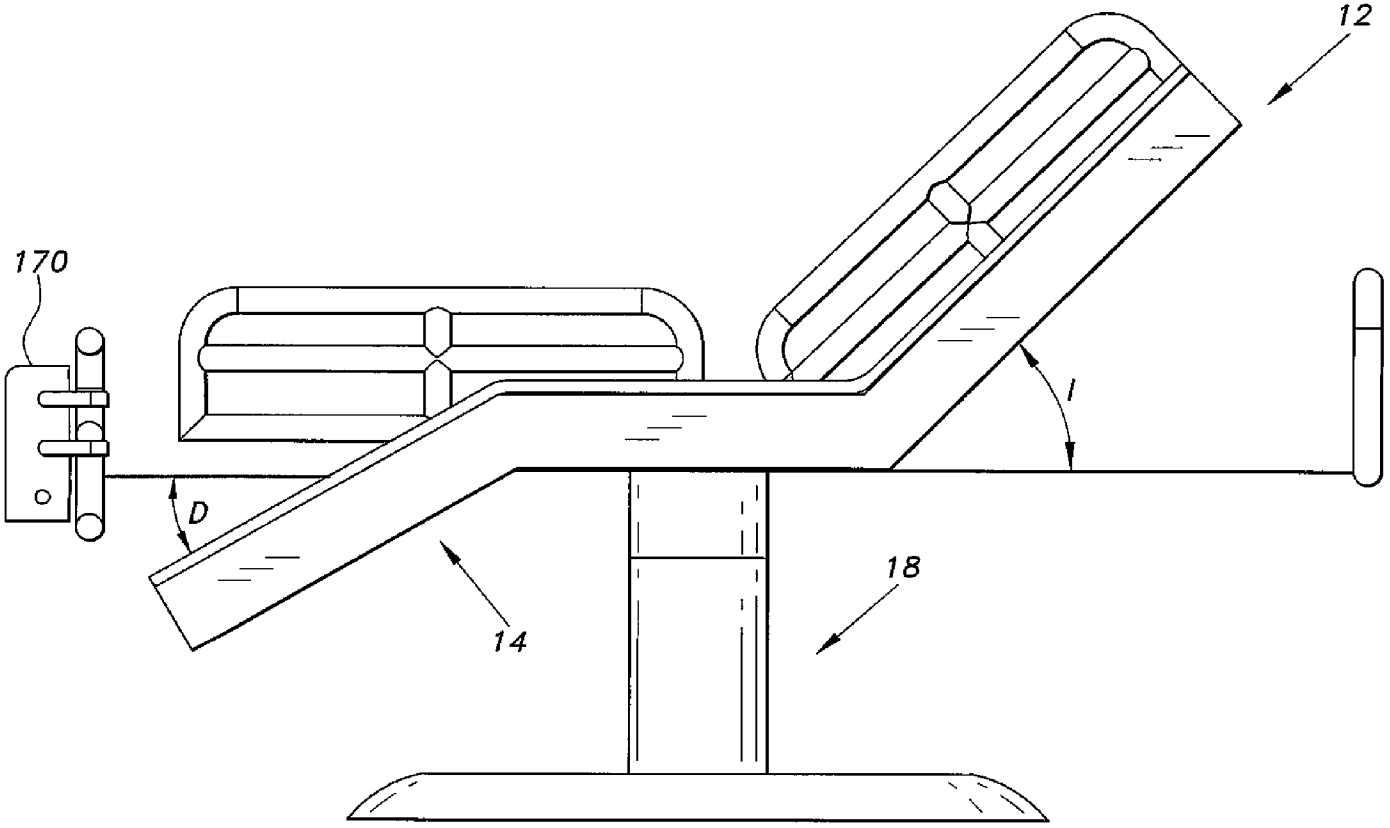
FIG. 1B is a side view of an embodiment of a mattress for relieving pressure ulcers according to the present invention having an inclined head portion and a declined foot portion.

Referring to FIGS. 1A and 1B, the mattress 10 can include a head portion 12 and a foot portion 14, which are configured to be movable between an inclined and a declined position. For example, the head portion 14 can have an incline (I) angle of 45° and the foot portion 16 can have a decline (D) angle of 30°, as illustrated in FIG. 1B. Further, the mattress 10 can be positioned on a support having at least one rail 195 to prevent a patient from falling. A base 18 of the support can elevate the mattress 10 to a desired height.

The mattress 10 can provide an increased contact area CA (FIG. 1A) between the patient's body B and the mattress 10. The first sponge layer 100 and the second sponge layer 150 can include a flexible, porous, and/or absorbant material, e.g., polyurethane foam, memory foam, or sponge material, that can support a load L (FIG. 2A) of a patient's body B (FIG.

1C). The first sponge layer 100 can have any suitable height, such as a height of 15 cm, which can support the load L of the patient's body B when the air mattress layer 120 is deflated. The second sponge layer 150 can have any suitable height, such as a height of 3 cm, which can distribute the air flow from the intermediate layer 140 to the contact area CA between the patient's body B and the mattress 10.

The air mattress layer 120 can be made of polyvinyl chloride (PVC), urethane plastic, or other suitable material that can be inflated. The air mattress layer 120 can be inflated by, for example, an air pump 180 housed in the ventilation system 170. The air pump 180 can be selectively activated. For example, the air pump 180 can be activated when a patient is situated on the mattress 10. The pressure exerted on the mattress 10 by the weight of the patient can cause the second electric conduction sheet 130 of the air mattress layer 120 to contact the first electric conduction sheet 110 of the first sponge layer 100. When the second electric conduction sheet 130 contacts the first electric conduction sheet 110, air can be drawn in through the third opening 182 and pass through a first tube 187 to inflate the air mattress layer 120.

When a patient is lying on the mattress 10 (FIG. 1C), bony prominences form fulcrums of load L on layers of muscle, fat, and skin. Since the maximum loads occur internally near bony prominences, the magnitude and duration of the pressure on the skin and underlying tissue can determine detrimental effects on the skin and on the underlying tissue. One way to prevent the formation of pressure ulcers is to increase the contact area between a person's body and the mattress. The contact area CA between the patient's body B and the mattress 10 is influenced by various factors, including weight. The maximum stress caused by body weight is much less for resting on an air mattress than that for resting on a solid surface. The air mattress layer 120 is flexible and conforms to the shape of the patient's body lying thereon. As such, air mattress layer 120 provides uniform stress distribution over the contact area CA. Typically the air pressure inside the air mattress layer 120 should be less in the case of a thin person than the air pressure needed for a heavier person so as to maximize the contact area CA between the patient's body B and the mattress 10. As such, the air pressure in the air mattress layer 120 can be adjusted, either manually or automatically at predetermined intervals, such as once every hour, so as to achieve the optimal contact area CA between the patient's body B and the mattress 10.

Maximizing the contact area CA between the body and the mattress can reduce the impact of pressure ulcers. To achieve the optimal contact area CA between the patient's body B and the mattress 10, calculations on the mass of each body segment were made. The calculation of the body segment mass for the head, chest, right and left foot, right and left forearm, right and left hand, right and left shank, right and left thigh, and right and left right upper arm are illustrated in Table 1.

TABLE 1

| Segment | Relative Mass (%) |
|---|---|
| Head | 6.94 |
| L. Foot | 1.37 |
| L. Forearm | 1.62 |
| L. Hand | .61 |
| L. Shank | 4.33 |
| L. Thigh | 14.16 |
| L. Upper Arm | 2.71 |
| Chest | 43.46 |
| R. Foot | 1.37 |
| R. Forearm | 1.62 |
| R. Hand | .61 |
| R. Shank | 4.33 |
| R. Thigh | 14.16 |
| R. Upper Ann | 2.71 |
| Total | 100 |

The relative mass values provided in Table 1 were obtained from Bishop, R. D. and Hay, J. G., *Basketball: The Mechanics of Hanging In The Air, Medicine and Science In Sports,* 11(3), 274-277 (1979).

Figure 1C:
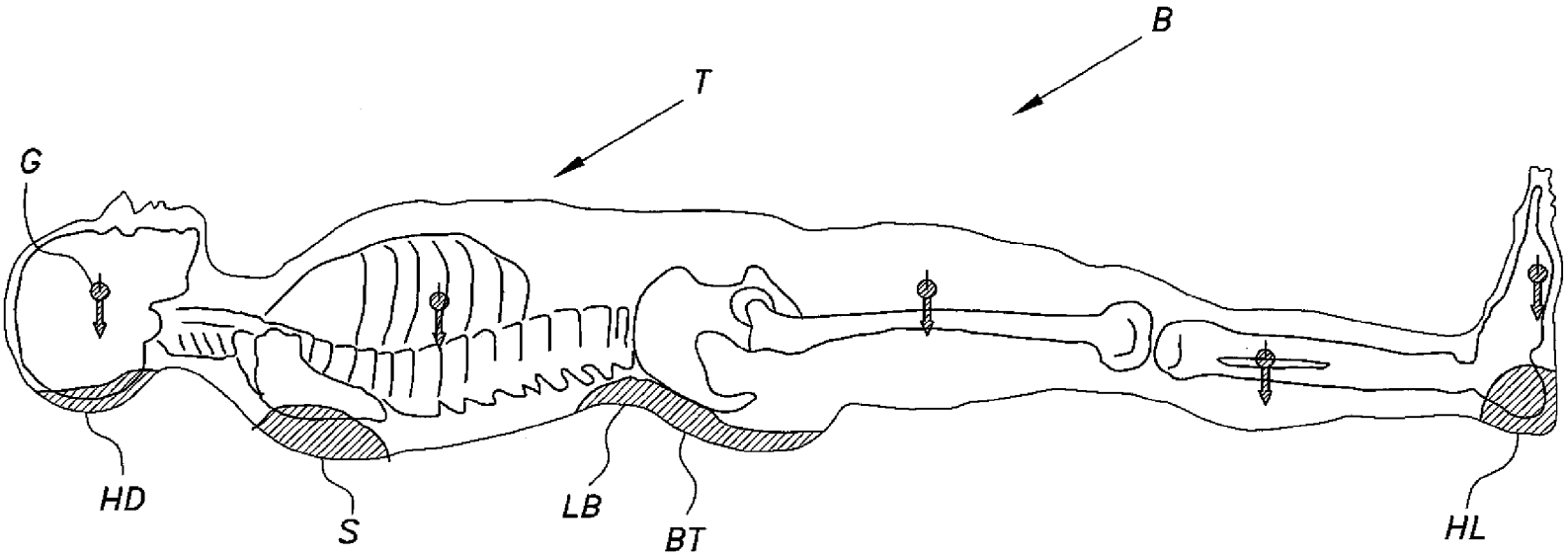
FIG. 1C is an illustration of a plurality of pressure locations on a human body susceptible to pressure ulcers.

The reaction forces exerted by the mattress 10 were calculated using the equation of simple beam reaction with hinged supports. For example, the load L of a patient's trunk T is distributed between the support forces at a patient's shoulders S, a patient's lower back LB, and a patient's buttocks BT (FIG. 1C). The sum of the reaction forces is equal to the load L. The contact areas CA are surfaces of supports, which can be predicted according to the curvature of the patient's body B. For example, the contact area CA for the shoulders will typically be 120 $cm^2$ if the patient lays on a solid surface, whereas if a patient lies on an air mattress having optimum air pressure, the contact area CA will typically be 1140 $cm^2$. The comparison of contact area CA and pressure for a patient lying on a solid surface and a patient lying on an air mattress, due to the varying load of the different body segments are provided in Table 2.

TABLE 2

| | | Solid Surface Contact Area (CA) | | Air Mattress Contact Area (CA) | | |
|---|---|---|---|---|---|---|
| Body Part | Reaction (R) due to Relative Mass (%) | Total Compressed area ($cm^2$) | Relative Pressure | Total Compressed area (cm2) | Relative Pressure | Percentage Reduction |
| Feet | 15.7 | 27 | 0.58 | 882 | 0.02 | 97% |
| Lower Back & Buttock | 35.18 | 94 | 0.37 | 550 | 0.06 | 84% |
| Shoulders | 32.84 | 120 | 0.27 | 1140 | 0.03 | 89% |
| Head | 6.94 | 16.7 | 0.42 | 100 | 0.07 | 38% |
| Total | 90.66 | 257.7 | 0.35 | 2672 | 0.03 | 91% |

As shown in Table 2, the reduction on the relative pressure under the body support area was 97%, 84%, 89%, and 38% for the feet, lower back & buttock, shoulders, and head, respectively, between a solid surface contact area CA and an air mattress contact area CA. It is to be noted that the total is less than 100% since the relative mass of the hands, forearms, and a portion of the upper arms was not taken into account.

Regardless, this significant reduction was principally due to increasing the contact area CA of the supporting areas by an air mattress. Optimal results are achieved using appropriate air pressure inside the air mattress, which plays an important role in controlling the contact area CA between the patient's body B and the mattress 10. It is to be noted that air mattresses with high air pressure inside can result in less contact area than those with less air pressure. As such, the air pressure should be adjusted for each person based on the patient's body weight or body mass index (BMI).

The intermediate layer 140 can be formed from flexible rubber or a suitable material that can stretch to conform to the patient's body B. The intermediate layer 140 can have any suitable thickness, such as a thickness of 2 cm. Further, the intermediate layer 140 can also include a plurality of vibrators 145, such as gentle vibrators, configured for vibrating and relieving shearing forces by altering the parallel movement of the tissue, as well as refreshing the blood flow to the superficial tissue.

Referring to FIGS. 2A, 2B, 2C, and 2D, each air release unit 200 includes a generally cylindrical body 210 extending between a top member 220 and a bottom member 230. The cylindrical body 210 can include an aperture 270 extending into an inner cavity 215 of the cylindrical body 210, and a spring-cap 240 within the cavity 215. Openings 225 can extend through the top member 220. A pressure plate 250 is positioned over the top member 220. Openings 260 defined in the pressure plate 250 can be aligned with openings 225 of the top member. A base 280 of the pressure plate 250 is in communication with the spring-cap 240.

Figure 2D:
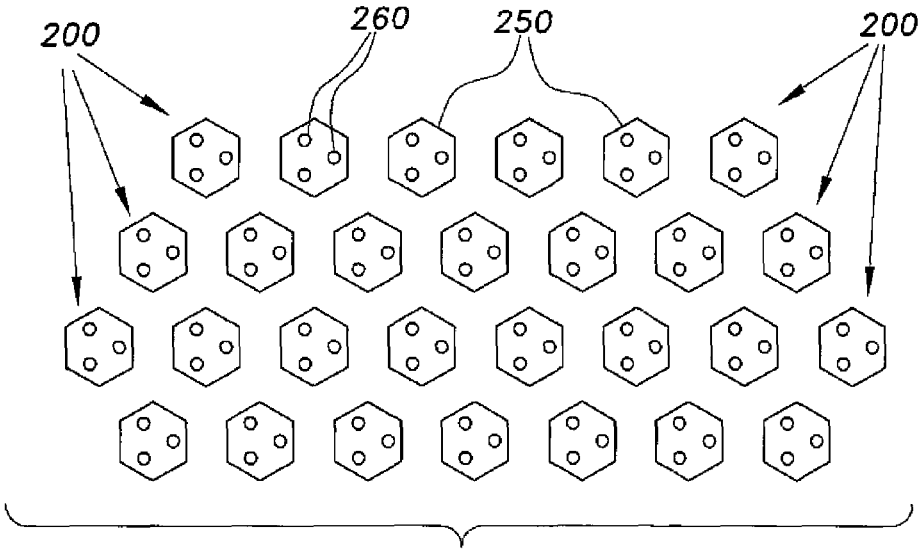
FIG. 2D is a diagram of an arrangement of a plurality of air release units according to the present invention.

Air from the air treatment unit can be pumped to and released by the air release units 200. For example, air A from the ventilation system 170 is released via a second tube 189 into the intermediary layer 140 and through the openings 270, as illustrated in FIG. 2A. The air is thereafter, selectively released by the plurality of air release units 200 into the second sponge layer 150. The plurality of air release units 200 can release the air A from the ventilation system 170 into the second sponge layer 150 when pressure is applied to the pressure plate 250, i.e., when the base 280 of the pressure plate 250 presses against the spring-cap 240; thereby opening the apertures 225 in the top member 220. If no pressure is applied to the pressure plate 250 of the corresponding air release unit 200, the spring-cap 240 can remain in its normally closed position; thereby, not releasing the air A into the second sponge layer 150. The spring-cap 240 is configured to allow air A to escape through the openings 260 in the pressure plate 250 at contact areas CA, or points at which pressure is exerted on the mattress 10 by a patient situated thereon. If no pressure is exerted on the mattress 10, all of the apertures 225 remain closed. The openings 260 in the pressure plate 230 can be aligned with openings 142 in the intermediate layer 140 for ventilating the contact area CA, or areas at which the patient's body B contacts the mattress 10. The plurality of air release units 200 can be positioned within the intermediate layer 140, as illustrated in FIGS. 2A and 2D. The flow of air A into the intermediate layer 140, as illustrated in FIG. 2A, can be adjusted in accordance with the patient's comfort and condition.

The air treatment unit 300 can help avoid increased skin temperatures that can be associated with increasing the contact area CA. Referring to FIG. 3, the air treatment unit 300 housed in the ventilation system 170 includes a plurality of (desirably three) receptacles 310*a*, 310*b*, 310*c*. The air treatment unit 300 is configured for mixing the air A from the ventilation system 170 with vapors from an essential/volatile oil and/or antibacterial liquid 320*a*, 320*b*, 320*c* contained in a respective one of the receptacles 310*a*, 310*b*, 310*c*. Each receptacle 310*a*, 310*b*, 310*c* can be of any suitable shape, such as a generally conical shape, for storing the essential volatile oil/antibacterial liquid 320*a*, 320*b*, 320*c*. The essential volatile oil/antibacterial liquid 320*a*, 320*b*, 320*c* may control the growth of bacterial, viral, and fungal infection in the second sponge layer 150 of the mattress 10. Each receptacle 310*a*, 310*b*, 310*c* can include a corresponding cylinder 330*a*, 330*b*, 330*c*. The cylinder 330*a*, 330*b*, 330*c* can be made of any suitable material, such as paper, for absorbing the essential volatile oil/antibacterial liquid 320*a*, 320*b*, 320*c* contained in the corresponding receptacle 310*a*, 310*b*, 310*c*, such as from the bottom of the receptacle 310*a*, 310*b*, 310*c*. Further, the cylinder 330*a*, 330*b*, 330*c* can include a plurality of openings 340*a*, 340*b*, 340*c* configured for allowing the air A to pass along a path denoted by arrows, as illustrated by FIG. 3, and absorb the vapors of the essential volatile oil/antibacterial liquid 320*a*, 320*b*, 320*c*.

The ozone gas generator 360 can be configured for generating ozone gas for patients suffering from Stage III or Stage IV pressure ulcers. The ozone gas can be mixed with the air A drawn in by the at least one compressor 185 and subsequently pumped into the intermediate layer 140 of the mattress 10 and, thereafter, selectively released, such as by the air release units 200, as previously described.

By way of operation, the air A can be drawn into the ventilation system 170 through opening 177 by at least one compressor 185 and pumped by the at least one compressor 185 through the ventilation system 170 and through the ozone generator 360 along a path denoted by the arrows illustrated in FIG. 3. After the air A is drawn in and pumped through the ozone generator 360, the air A proceeds through a third tube 315 into the cylinder 330*a* positioned in the receptacle 310*a*. Once the air A enters the cylinder 330*a*, the air A passes through the plurality of openings 340*a* in the cylinder 330*a* so as to absorb the vapors from the essential volatile oil/antibacterial liquid 320*a* contained in the receptacle 310*a*. After the air A passes through the plurality of openings 340*a*, the air A flows into the cylinder 330*b* and through the plurality of openings 340*b* in the cylinder 330*b* so as to absorb the vapors from the essential volatile oil/antibacterial liquid 320*b* contained in the receptacle 310*b*. After the air A passes through the plurality of openings 340*b*, the air A then flows into the cylinder 330*c* and through the plurality of openings 340*c* in the cylinder 330*c* so as to absorb the vapors from the essential volatile oil/antibacterial liquid 320*c* contained in the receptacle 310*c*. After the air A passes through each of the receptacles 310*a*, 310*b*, 310*c*, the air A is emitted from the ventilation system 170 through the second tube 189 and into the intermediate layer 140, as illustrated in FIG. 3, and, thereafter, selectively released into the second sponge layer 150, as illustrated in FIG. 2A.

Referring to FIG. 1, the paper sheet layer 160 can be of any suitable size. The paper sheet layer 160 includes a plurality of (desirably two) layers of porous paper 165, each layer having a plurality of wire strips, such as small flexible wire strips, forming a sensor matrix 167. The sensor matrix 167 can be in communication with at least one controller/processor 430. The sensor matrix 167 can be configured for detecting moisture, such as from bed wetting, sweating, or incontinence. In the case of a bed wetting, for example, upon detecting moisture the sensor matrix 167 sends an alert signal to the at least one controller/processor 430 to activate an alert, such as a visual alarm. The visual alarm can be a red LED light, or an auditory alarm emitted from a speaker 192 to alert others of the bedding wetting on the paper sheet layer 160 of the mattress 10.

Figure 4:
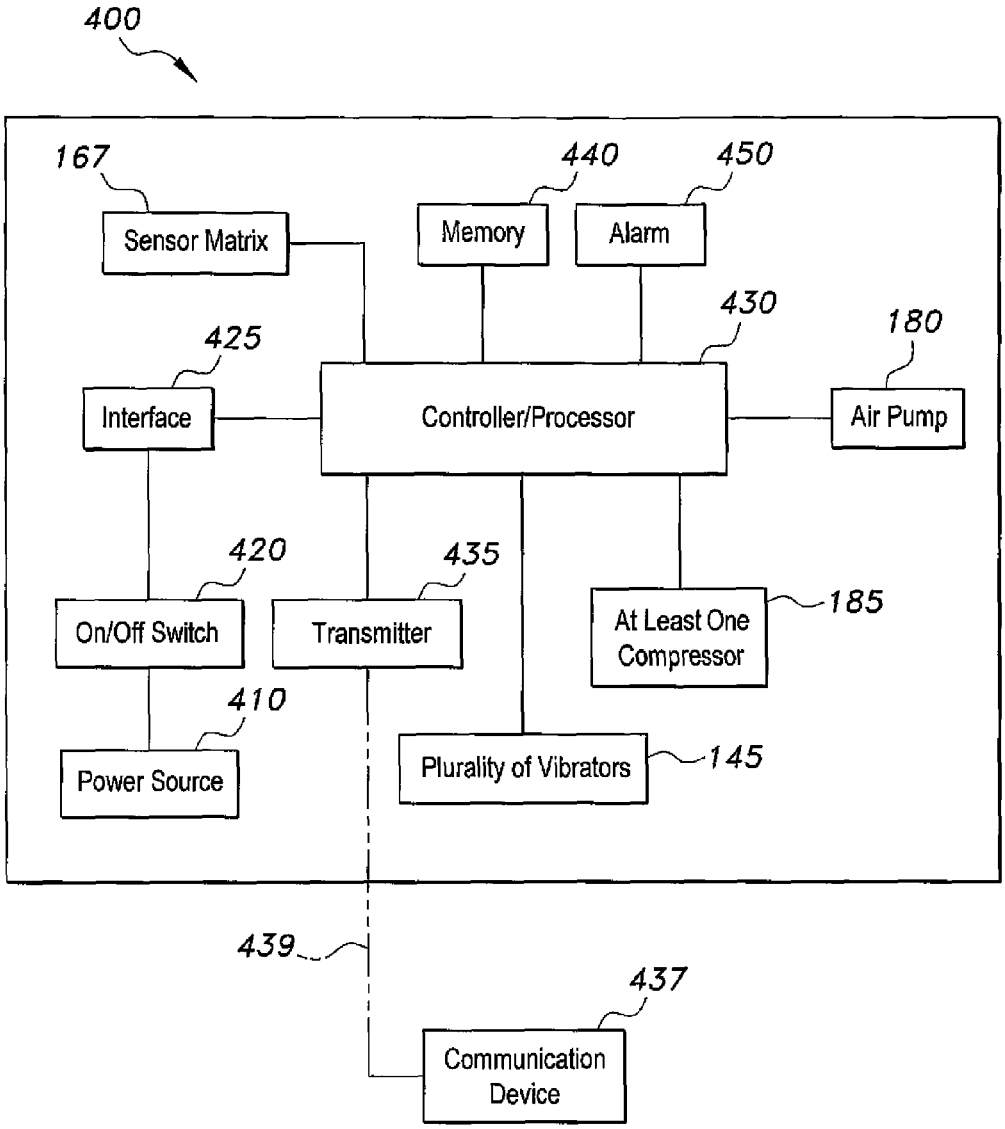
FIG. 4 is a block diagram of a generalized system for use in connection with a mattress for relieving pressure ulcers according to the present invention.

Referring to FIG. 4, a generalized system 400 for use with the mattress 10, such as in connection with the control panel 175 of the ventilation system 170, is illustrated. Data reflecting or relating to a patient, such as data corresponding to the patient's height, weight, age, and condition can be entered into the generalized system 400 via any suitable type of interface 425, such as a keypad. The interface 42 can be in communication with at least one controller/processor 430 that can be any suitable type of computer processor, such as a microcontroller, an application specific integrated circuit (ASIC), or a programmable logic controller (PLC). The information, such as programs or instructions, entered into the generalized system 400 can be provided to the at least one controller/processor 430 for processing and analysis. The information can be received and analyzed and can be stored in a memory 440 associated with the at least one controller/processor 430. Further, the at least one controller/processor 430 can be arranged in communicating relation with the sensor matrix 167, an alarm 450, the air pump 180, the at least one air compressor 185 of the ventilation system 170, and the plurality of vibrators 145.

The generalized system 400 also includes an on/off switch 420, a transmitter 435, such as for wireless transmission or for wireless communication of information from the at least one controller/processor 430 to a communication device 437. For example, the transmission can also be a wired communication or transmission, relating to the posture of the patient's body B lying on the mattress 10. The communication or the transmission of information from the transmitter 435 to the communication device 437, is respectively indicated by the dotted lines 439. The communication device 437 can be any suitable computing device, such as a standalone computer, computer terminal, portable computing device, networked computer or computer terminal, or networked portable device that can include a microcontroller, an ASIC, or a PLC.

Further, it is to be noted that the memory 440 can be adapted to store data and information, as well as program(s) or instructions for implementing operation of the ventilation system 170 and the air pump 180 of the mattress 10. The memory 440 can be any suitable type of computer readable and programmable memory, such as non-transitory computer readable media, random access memory (RAM) or read only memory (ROM), for example. The generalized system 400 can also be powered by a suitable power source 410.

Calculations, determinations, or data transmission, the sending or receiving of control signals or commands, or providing information in relation to the patient's position, such as the activation of the plurality of the vibrators 145 in the intermediate layer 140 or the activation of the ventilation system 170 are performed or executed by the at least one controller/processor 430. Also, the functions of the at least one controller/processor 430 can also be performed by an integrated single controller/processor in the generalized system 400. Further, information, such as related to the position of a patient's body B, can be displayed on a suitable display associated with the communication device 437.

The at least one controller/processor 437 can be associated with, or incorporated into, any suitable type of computing device, such as a PLC or an ASIC. The components of generalized system 400 including the at least one controller/processor 430, the memory 440, the transmitter 435, the alarm 450, the air pump 180, the at least one air compressor 185, the plurality of vibrators 145, and any associated computer readable media are in communication with one another by any suitable type of data bus, as is well known in the art.

By way of operation, prior to a patient lying on the mattress 10, either the patient or another person, such as a medical practitioner, can activate the ventilation system 170 and, in turn, the air pump 180, by turning the on/off switch 420 to the "on" position. When the load L of the patient's body B causes the second electric conduction sheet 130 to make contact with the first electric conduction sheet 110, the air pump 180 can draw air in through the third opening 182 and inflate the air mattress layer 120 via the first tube 187. The air pump 180 can continue to inflate the air mattress layer 120 until the second electric conduction sheet 130 is no longer in contact with the first electric conduction sheet 110.

Depending on the posture of the patient lying on the mattress 10, the load L of the patient's body parts, such as the head H, shoulders S, lower back LB, buttocks BT, and heals HL, can activate the air release units 200 by applying pressure to the corresponding pressure plates 250. The pressure will cause the spring-cap 240 of each air release unit 200 to compress, and release air A stored in the inner cavity 215 into the second sponge layer 150 through the openings 260 and corresponding first openings 142 in the intermediate layer 140, as illustrated in FIG. 2A. The air A in combination with the ozone gas and the vapors of the volatile oil and antibacterial liquid 320*a*, 320*b*, 320*c* can then aerate the second sponge layer 150, as well as decrease the risk of pressure ulcers due to high temperature, sweating, and humidity within the contact area CA between the patient's body B and the mattress 10.

The plurality of vibrators 145 can also be activated and programmed to vibrate for specific intervals, such as for 30 seconds, once every fifteen minutes, according to the patient's comfort and condition so as to relieve shearing forces, which typically result from applied forces causing two contiguous internal body parts to deform in a transverse plan (i.e. due to lateral force—normally when skin is in contact with a support surface and the underlying tissue moves parallel to the support and the skin shear forces develop). Further, the sensor matrix 167 can also be activated to detect excessive moisture, such as from bed wetting or sweating, and alert a medical practitioner that the patient's sheets need to be changed so as not to develop or worsen any existing pressure ulcers.

It is to be understood that the present invention is not limited to the embodiments described above, but encompasses any and all embodiments within the scope of the following claims.

We claim:

1. A mattress for relieving pressure ulcers, the mattress comprising:

a plurality of layers including:

a first sponge layer having a first electric conducting sheet;

an air mattress layer located above the first sponge layer and having a second electric conducting sheet;

an intermediate layer located above the air mattress layer and having a plurality of air release units, the intermediate layer including a plurality of first openings, each first opening being arranged in communicating relation to a corresponding one of the plurality of air release units, wherein the intermediate layer further comprises a plurality of vibrators;

a second sponge layer located above the intermediate layer; and a paper sheet layer located above the second sponge layer and comprising a plurality of layers of porous paper, each layer of porous paper having a plurality of wire strips forming a sensor matrix for detecting moisture;

a ventilation system having an air treatment unit including an ozone generator, the ventilation system being arranged in communicating relation with the plurality of air release units and configured to supply air and ozone to the plurality of air release units; and an air pump.

2. The mattress for relieving pressure ulcers according to claim 1, wherein the plurality of vibrators are configured to vibrate at predetermined intervals.

3. The mattress for relieving pressure ulcers according to claim 1, wherein the intermediate layer includes rubber.

4. The mattress for relieving pressure ulcers according to claim 3, wherein each of the air release units includes an inner cavity, a compressible valve within the inner cavity, and at least one aperture through which air from the inner cavity may pass into another one of the plurality of mattress layers.

* * * * *